United States Patent [19]

Nicoloso

[11] Patent Number: 4,678,877

[45] Date of Patent: Jul. 7, 1987

[54] OPERATING MECHANISM FOR A CIRCUIT-BREAKER, AND A CIRCUIT-BREAKER FITTED WITH THE MECHANISM

[75] Inventor: Dante Nicoloso, Jonage, France

[73] Assignee: Alsthom, Paris, France

[21] Appl. No.: 922,225

[22] Filed: Oct. 23, 1986

[30] Foreign Application Priority Data

Oct. 23, 1985 [FR] France ..... 85 15751

[51] Int. Cl.[4] ..... H01H 33/42

[52] U.S. Cl. ..... 200/148 F; 200/153 SC

[58] Field of Search ..... 200/148 F, 153 SC

[56] References Cited

U.S. PATENT DOCUMENTS

| | | | |
|---|---|---|---|
| 4,162,385 | 7/1979 | Bould et al. | 200/153 SC |
| 4,491,709 | 1/1985 | Chabot et al. | 200/153 SC |
| 4,535,208 | 8/1985 | Wallimann et al. | 200/148 F |

*Primary Examiner*—Robert S. Macon

*Attorney, Agent, or Firm*—Sughrue, Mion, Zinn, Macpeak, and Seas

[57] ABSTRACT

A mechanism for operating a circuit-breaker and suitable for causing a circuit-breaker to perform a rapid opening-closing-re-opening cycle, said circuit-breaker including a set of fixed contacts and a set moving contacts, said operating mechanism including an operating rod (13) for connection to said set of moving contacts, a first spring (24) imparting motion, when it expands, to said rod in a direction corresponding to circuit-breaker opening, a second spring capable of storing at least twice as much energy as said first spring and imparting motion, when it expands, to said rod in a direction which corresponds to said circuit-breaker closing, said mechanism further including means for ensuring that expansion of said second spring causes said first spring to be re-compressed, and each of said first and second springs being associated with a respective controllable locking member, said circuit-breaker operating mechanism being characterized in that it further includes a first cylinder (20) having said operating rod passing axially therethrough, a second cylinder (22) coaxial with said first cylinder, fixed relative thereto, and containing said first spring (24) therein, and a third cylinder (50) coaxial with said first and second cylinders and disposed between said first cylinder and said second cylinder and being movable relative thereto, said second spring (54) being disposed between said first and second cylinders, said third cylinder including a collar (50A) serving as an abutment for said second spring, and enabling said third cylinder to slide in said first cylinder and co-operating with a set of levers (71, 72) which are hinged on and fixed to said rod for driving said rod when said second spring expands.

5 Claims, 6 Drawing Figures

OPERATING MECHANISM FOR A CIRCUIT-BREAKER, AND A CIRCUIT-BREAKER FITTED WITH THE MECHANISM

The present invention relates to an operating mechanism for a circuit-breaker, and more particularly to a linear motion operating mechanism for communicating opening motion in one direction and closing motion in the opposite direction to the drive rod of the circuit-breaker.

BACKGROUND OF THE INVENTION

An aim of the invention is to provide an operating mechanism capable of performing a rapid open-close-open cycle (a cycle comprising in succession: circuit-breaker opening, circuit-breaker closing and circuit-breaker opening a second time), followed after a suitable time delay (for example not less than 15 seconds) by a rapid close-open cycle (i.e. a cycle comprising: circuit-breaker closing followed by circuit-breaker opening).

U.S. Pat. No. 4,162,385 describes a two-spring control mechanism capable of performing the above-mentioned cycle. A drawback of this prior art device lies in the energy stored in the springs being transmitted from one spring to the other, as well as being transmitted to the circuit-breaker operating member with transmission taking place via links hinged on various shafts. Unfortunately, high tension circuit-breakers, and in particular puffer circuit-breakers require the contacts to move rapidly so that the opening and closing operating time for the contacts is as short as possible. This makes it important for the operating mechanism to be disposed as close as possible to the drive rod for transmitting the operating motion.

An aim of the invention is to provide an operating mechanism in which energy is transferred from one spring to the other and from the springs to the moving rod without passing through links, rods, or other motion-transmitting components.

Another aim of the invention is to provide an operating mechanism in which the "energy-storage" and the "action" functions are physically separable, in particular so as to be able to remotely control circuit-breaker without having to use mechanical members for transmitting rapid engagement and disengagement motions.

SUMMARY OF THE INVENTION

The present invention provides a mechanism for operating a circuit-breaker and suitable for causing a circuit-breaker to perform a rapid opening-closing-re-opening cycle, said circuit-breaker including a set of fixed contacts and a set moving contacts, said operating mechanism including an operating rod for connection to said set of moving contacts, a first spring imparting motion, when it expands, to said rod in a direction corresponding to circuit-breaker opening, a second spring capable of storing at least twice as much energy as said first spring and imparting motion, when it expands, to said rod in a direction which corresponds to said circuit-breaker closing, said mechanism further including means for ensuring that expansion of said second spring causes said first spring to be re-compressed, and each of said first and second springs being associated with a respective controllable locking member, said circuit-breaker operating mechanism including the improvement whereby it further includes a first cylinder having said operating rod passing axially therethrough, a second cylinder coaxial with said first cylinder, fixed relative thereto, and containing said first spring therein, and a third cylinder coaxial with said first and second cylinders and disposed between said first cylinder and said second cylinder and being movable relative thereto, said second spring being disposed between said first and second cylinders, said third cylinder including a collar serving as an abutment for said second spring, and enabling said third cylinder to slide in said first cylinder and co-operating with a set of levers which are hinged on and fixed to said rod for driving said rod when said second spring expands.

BRIEF DESCRIPTION OF THE DRAWINGS

An embodiment of the invention is described by way of example with reference to the accompanying drawings, in which.

DESCRIPTION OF PREFERRED EMBODIMENT

Figure 1:
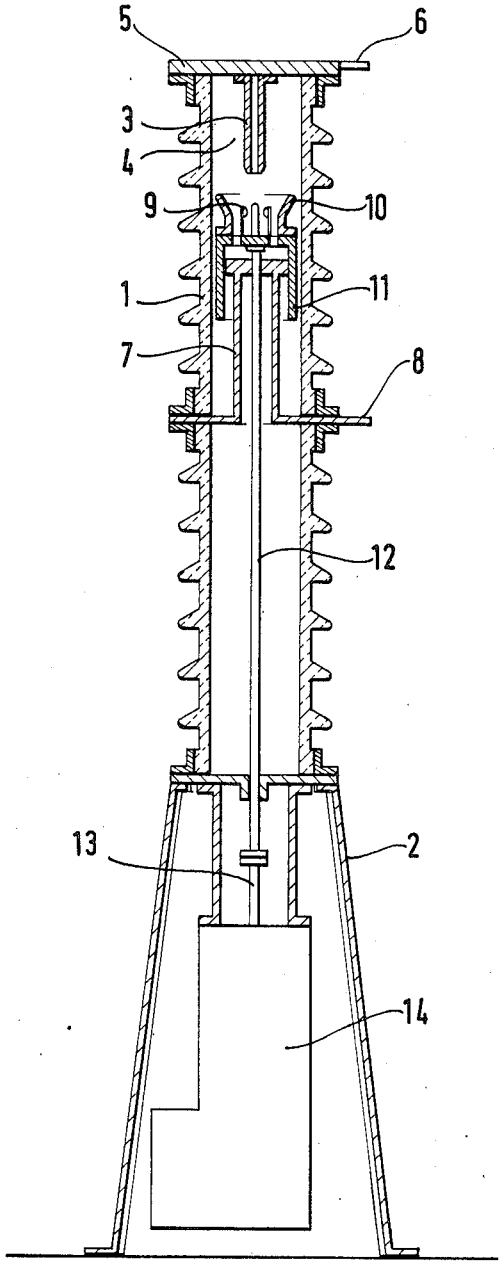
FIG. 1 is a diagrammatic elevation view in partial section through a single pole of a circuit-breaker fitted with an operating mechanism in accordance with the invention.

In FIG. 1, reference 1 designates an insulating circuit-breaker column. The column is supported by a frame 2 which is fixed to the ground.

A fixed contact 3 is placed in a chamber 4 of the column, which chamber is filled with a dielectric gas such as sulfur hexafluoride.

The chamber 4 is delimited at its top end by a cover 5 having a terminal 6 fixed thereto, and at its bottom end by a partition 7 having a terminal 8 fixed thereto.

The moving assembly comprises contacts 9 and a nozzle 10 fixed to a compression cylinder 11. The cylinder is connected to a drive rod 12 which passes through the partition 7 in sealed manner.

The rod 12 is fixed to a rod 13 forming a part of an operating mechanism in accordance with the invention and represented in FIG. 1 by a polygonal, generally L-shaped outline 14.

The operating mechanism 14 is fixed to the frame 2 in the immediate vicinity of the circuit-breaker drive rod 12.

Figure 2:
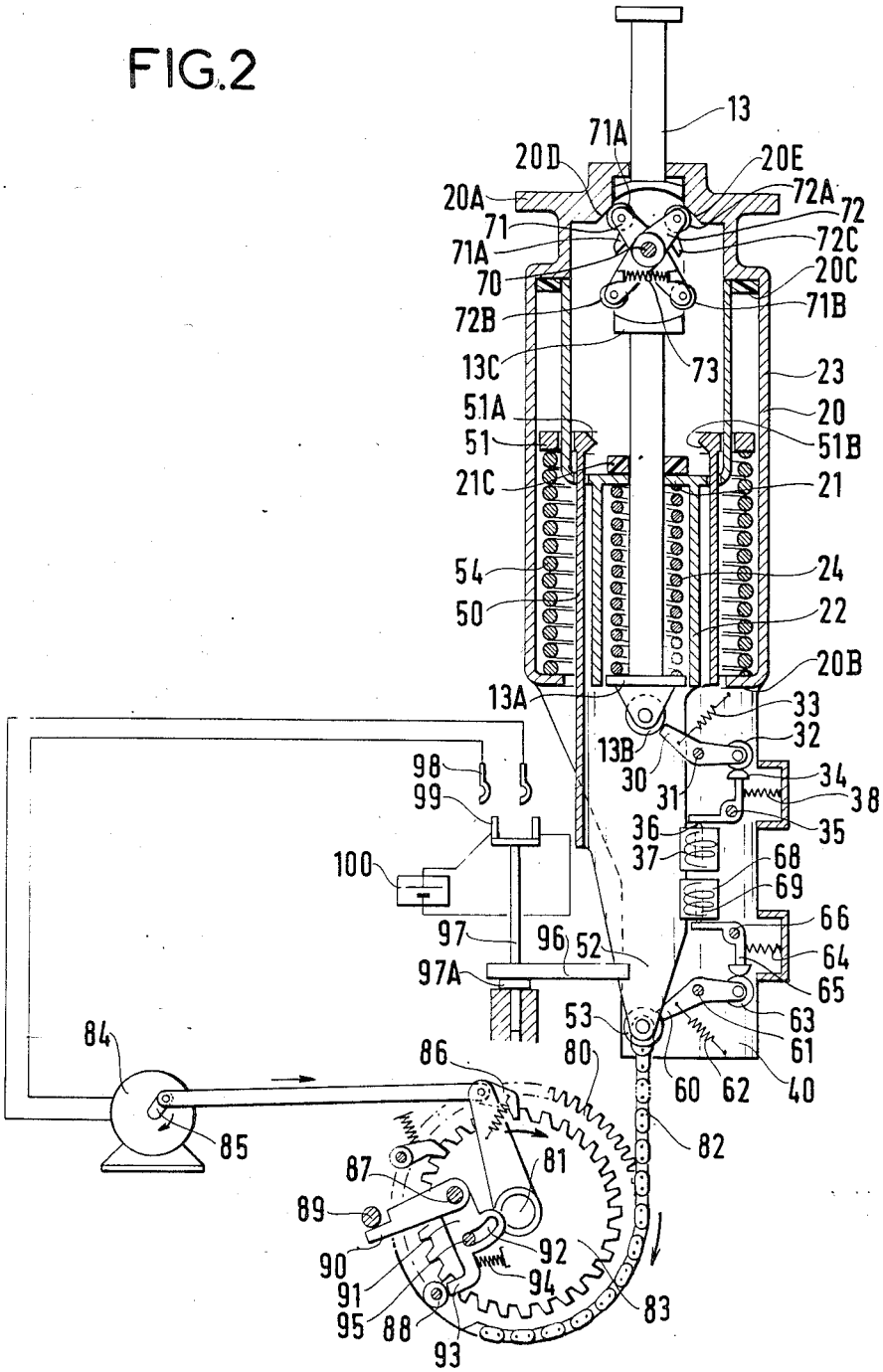
FIGS. 2 to 5 are diagrammatic views in partial section of the operating mechanism in accordance with the invention in various positions during an open-close-open cycle.

Reference is now made to FIG. 2 which shows the operating mechanism 14.

The mechanism comprises a cylindrical body 20 which is open at its bottom end and which is closed at its top end by a cover 20A having a central orifice through which the rod 13 passes, which rod is connected, as explained above, to the drive rod 12 for the moving equipment in the circuit-breaker.

The rod 13 passes through the top end 21 of a fixed cylinder 22 which is coaxial with the cylinder 20 to which it is fixed by arms 23.

A spring 24 is disposed between the top end 21 of the cylinder 22 and a collar 13A in the rod 13. In FIG. 2, the spring 24 is shown in its compressed or loaded position.

The rod 13 is in its other position (circuit-breaker closed) and is held there by means of a locking lever 30 which is mounted to rock about an axis 31 and which bears against a wheel 13B at the bottom end of the rod 13. The locking lever 30 is itself held in a fixed position by a bell crank 34 pivotally mounted on an axis 35 having one end bearing against the wheel 32 mounted on the lever 30 and having its other end bearing on the core 36 of an electromagnetic winding 37.

The locking lever 30 and the bell crank 34 are provided with return springs having respective references 33 and 38.

The axes of the lever 30, the bell crank 34, and the winding 37 are fixed relative to a plate 40 which is fixed to the bottom of the cylinder 20.

A moving cylinder 50 is disposed inside the cylinder 20 coaxially with the cylinders 20 and 22. The moving cylinder 50 is free to slide by virtue of a collar 51 having slots through which the arms 23 pass. The bottom 52 of the cylinder 50 has a cutout for receiving the locking lever 30 and also serves to support an end wheel 53.

A spring 54 is disposed between the cylinders 20 and 50. One end of the spring bears against the collar 51, and its other end bears against an inwardly directed lip 20B on the bottom of the cylinder 20.

The spring 54 is shown in its compressed or loaded position in FIG. 2.

The cylinder 50 is fixed in place by means of a locking lever 60 which rocks about an axis 61 and which is fitted with a return spring 62 and a wheel 63. The locking lever 60 is itself held in place by means of a bell crank 65 having an axis 66 and provided with a return spring 64. The bell crank 65 cooperates in the same way as the bell crank 34 with an electromagnetic winding 68 having a core 69.

The rod 13 has a hinge 70 with levers such as 71 and 72 pivoting thereon, with the levers being fitted with end wheels 71A, 71B and 72A, 72B respectively. A spring 73 tends to urge the levers away from each other. Abutments 71C and 72C limit the extent to which the levers may move apart.

The operating mechanism in accordance with the invention also includes an assembly for re-loading the springs, which assembly comprises:

a toothed wheel 80 rotatably mounted about an axis 81 and suitable for winding in a chain 82 which is fixed to the bottom end 52 of cylinder 50;

a ratchet wheel 83 rotatably mounted about the same axis as the wheel 80 and free to rotate about said axis, being rotated by a motor 87 which drives a crank 85 which is linked to a pawl system 86; and a locking system capable of locking the wheels 80 and 83 together, said locking system comprising a shaft 87 fixed to the wheel 83, a wheel 88 fixed to the wheel 80, a fixed abutment 89, and an L-shaped lever hinged about the shaft 87 and including an arm 90, and an arm 91 having a slot 92, a locking finger 93, and a return spring 94 connected to the wheel 83.

A peg 95 fixed to the wheel 83 passes through the slot 92 and serves to limit the stroke of the lever 90–91.

The motor 84 is driven by a source of electricity 100 via a contactor having a fixed set of contacts 98 and a moving set of contacts 99. The contacts 99 are moved by means of an arm 96 which is fixed to the bottom end 52 of the cylinder 50 and which co-operates with an abutment 97A of the contact-supporting rod 97.

The spring 54 is chosen to be capable of storing at least twice as much energy as the spring 24.

The mechanism in accordance with the invention operates as follows.

When the circuit-breaker is in its closed position, the rod 13 connected to the rod 12 of the circuit-breaker is in its high position (FIG. 2).

Both springs 24 and 54 are in the compressed state. In the event of a fault, an instruction to open the circuit-breaker is given by means of an electric pulse applied to the winding 37. The core 38 thereof then moves and thrusts against one arm of the bell crank 34, thereby pivoting the bell crank. The wheel 32 at the end of the locking lever 30 is thus released, and the lever 30 pivots under the force applied thereto by the wheel 13B.

The spring 24 then expands, driving the rod 13 and thus opening the circuit-breaker.

Figure 3:
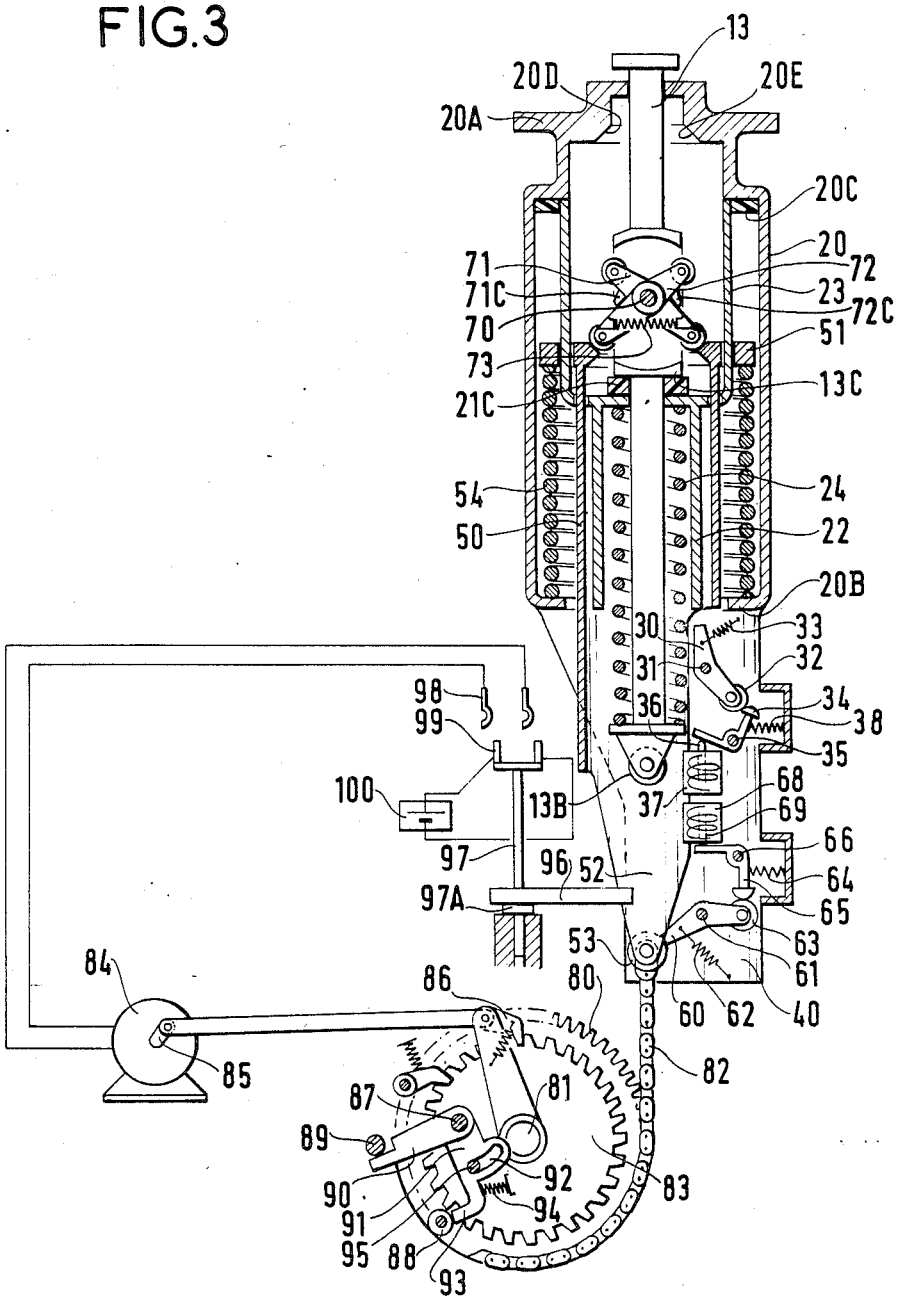

The movement is damped by means of a collar 13C on the rod 13 coming into contact with a layer of resilient material 21C placed on the top 21 of the cylinder 22 (see FIG. 3).

The arms 71 and 72 on the rod 13 move apart once they have left the cover 20A. In the FIG. 3 position (circuit-breaker open), the arms 71 and 72 bear against shoulders 51A and 51B on the collar 51.

Figure 4:
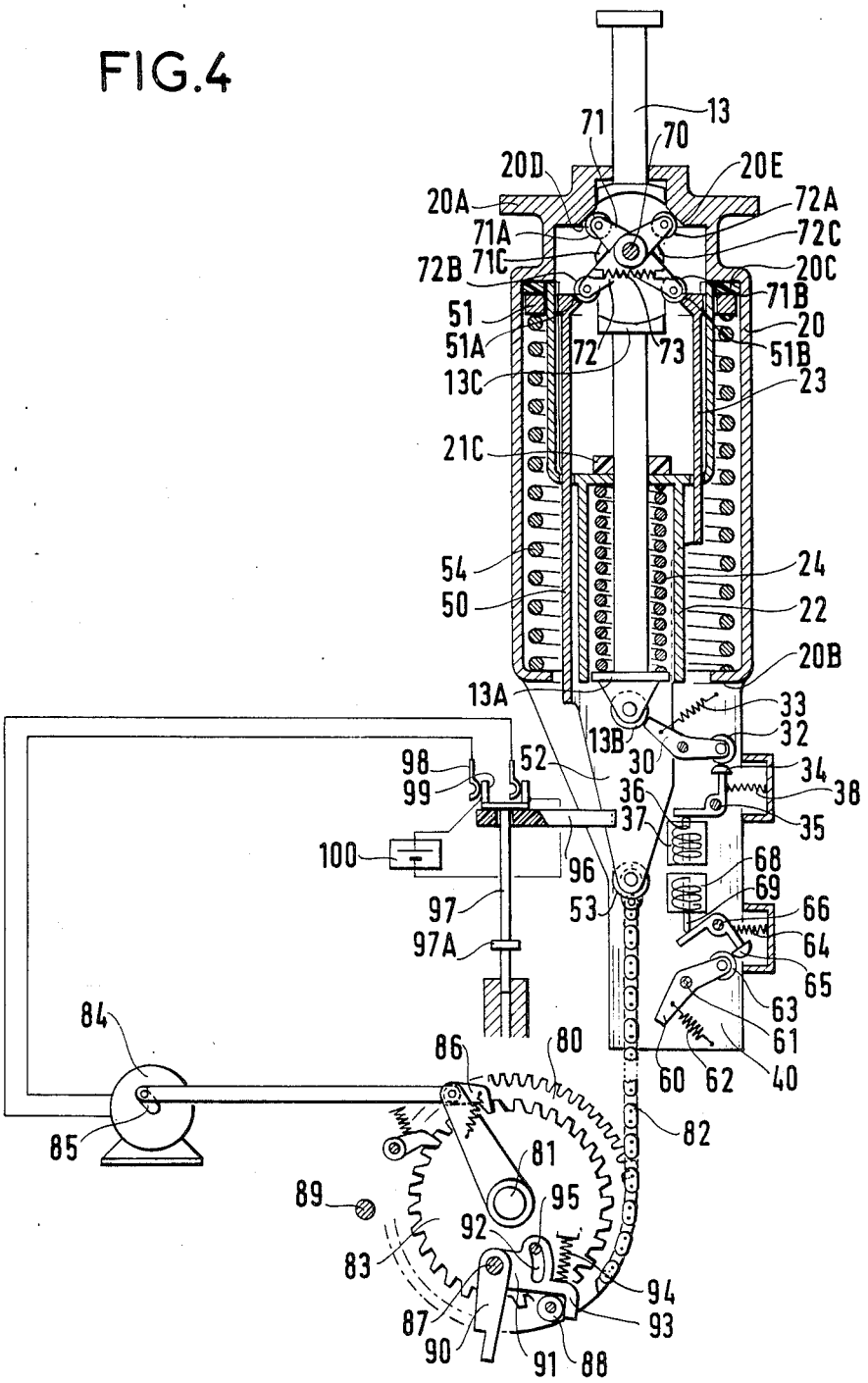
Figure 5:
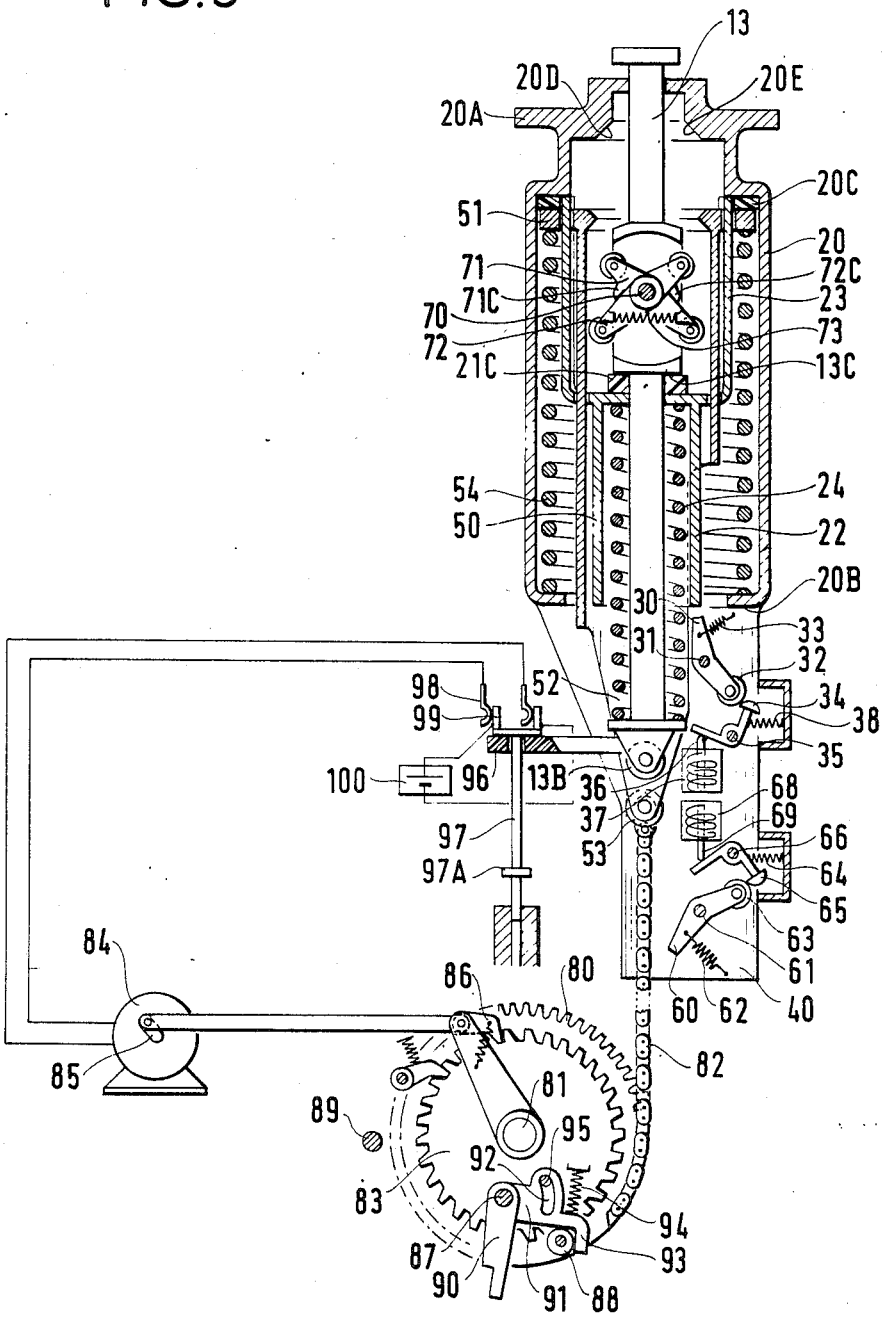

A re-closing instruction is given by means of an electric pulse applied to the winding 68 (see FIG. 4).

The core 69 of the winding rocks the bell crank 65 which releases the wheel 63 on the lever 60 which in turn rocks under the effect of the spring 62. The wheel 53 is thus released, thereby allowing the spring 54 to expand, thus moving the cylinder 50 upwardly.

The rod 13 follows the motion of the cylinder 50 by virtue of the wheels 71B and 72B at the ends of the shoulders 51A and 51B.

At the end of this upwards stroke, which is damped by means of a resilient lining 20C on the cover 20A, the arms 71 and 72 move back towards each other by virtue of their wheels 71A and 72A rolling over slopes 20D and 20E, with the wheels 71B and 72B releasing the slopes 51A and 51B.

The upwards motion of the rod 13 recompresses the spring 24 and the rod is re-locked in its upper position by the lever 30.

The mechanism is then ready to perform a second opening instruction, again given in the form of an electric pulse applied to the winding 37.

Operation then proceeds in exactly the same way as for the first opening instruction.

At the end of the intermediate closure stage (see FIG. 4), the arm 96 has moved the contacts 99 so as to close the circuit for powering the motor 84. The motor thus starts up and drives the wheel 83. The finger 93 pulls round the abutment 88, thereby rotating wheel 80 and moving the chain 82. This serves to re-compress the spring 54 progressively.

At the end of the spring-compression operation, the arm 90 abuts against the abutment 89, thereby rotating the L-shaped ever 90–91 and thus releasing the finger 93.

Simultaneously, the bottom end 52 of the cylinder 50 engages the locking lever 60.

The arm 96 engages the abutment 97A and thus opens the electric circuit powering the motor 84. Under some circumstances of circuit-breaker use, an open-close-open cycle is followed by another close-open cycle after a time delay of about 15 seconds. This period is long enough for the spring 54 to be re-compressed, i.e. re-loaded.

The close-open cycle is obtained by applying a pulse to the winding 37 followed by a pulse to the winding 68.

Figure 6:
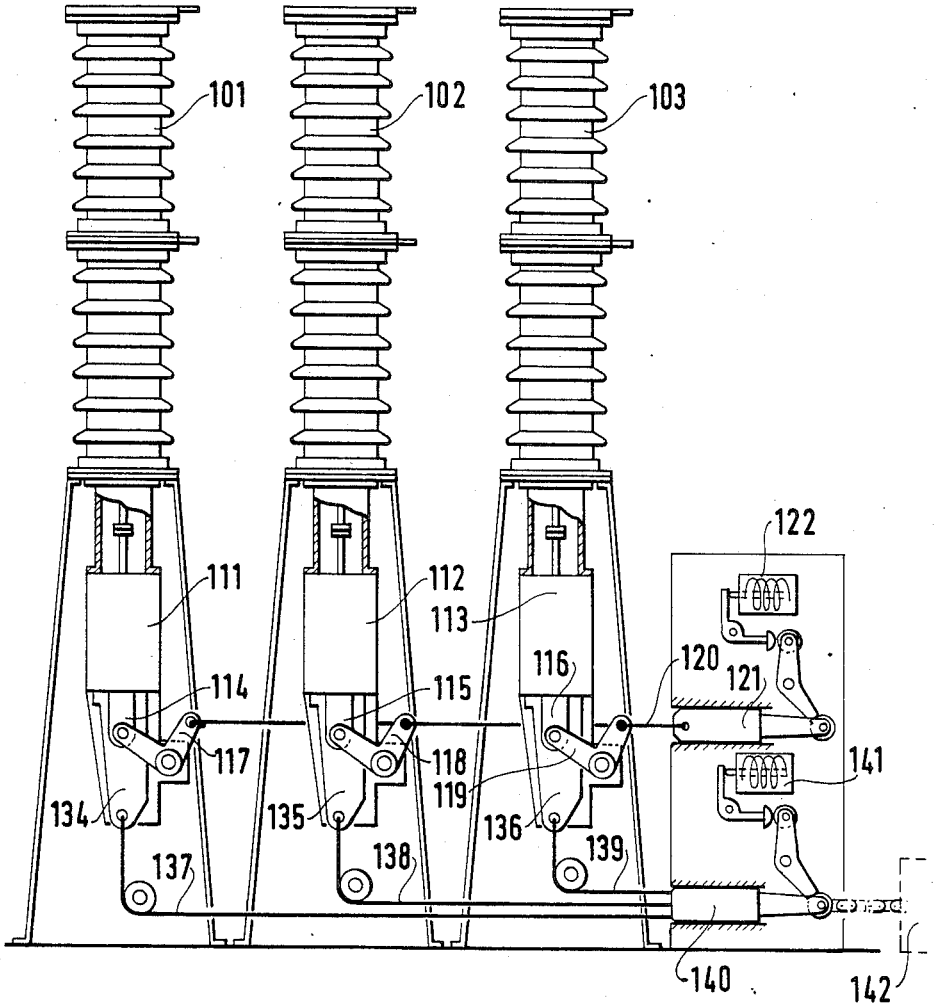
FIG. 6 is a diagrammatic elevation view of a three-pole circuit-breaker fitted with three operating mechanisms in accordance with the invention.

FIG. 6 shows a three-pole circuit-breaker comprising three columns 101, 102, and 103, each of which includes a respective circuit-breaking chamber.

Each column is surrounded with an operating mechanism in accordance with the invention and respectively referenced 111, 112, and 113.

Each of these mechanisms is identical to the mechanisms described with reference to FIGS. 2 to 5, except in that they share common locking means.

Thus, the ends 114, 115, and 116 of the rods are fixed to bell cranks 117, 118, and 119 which are interconnected by a cable 120 which is also connected to a locking member 121 under the control of an electromagnet 122.

Similarly, the ends 134, 135, and 136 of the engagement assemblies are connected by cables 137, 138, and 139 to a common locking member 140 under the control of an electromagnet 141 and connected to a re-loading device 142, analogous to that described above.

It can be seen, that in this three-pole circuit, the active portions (i.e. the springs) are in direct communication with the motion of the circuit-breaker rods, without any links or rodding being inserted therebetween.

I claim:

1. A mechanism for operating a circuit-breaker and suitable for causing a circuit-breaker to perform a rapid opening-closing-re-opening cycle, said circuit-breaker including a set of fixed contacts and a set moving contacts, said operating mechanism including an operating rod for connection to said set of moving contacts, a first spring imparting motion, when it expands, to said rod in a direction corresponding to circuit-breaker opening, a second spring capable of storing at least twice as much energy as said first spring and imparting motion, when it expands, to said rod in a direction which corresponds to said circuit-breaker closing said mechanism further including means for ensuring that expansion of said second spring causes said first spring to be re-compressed, and each of said first and second springs being associated with a respective controllable locking member, said circuit-breaker operating mechanism including the improvement whereby it further includes a first cylinder having said operating rod passing axially therethrough, a second cylinder coaxial with said first cylinder, fixed relative thereto, and containing said first spring therein, and a third cylinder coaxial with said first and second cylinders and disposed between said first cylinder and said second cylinder and being movable relative thereto, said second spring being disposed between said first and second cylinders said third cylinder including a collar serving as an abutment for said second spring, and enabling said third cylinder to slide in said first cylinder and co-operating with a set of levers which are hinged on and fixed to said rod for driving said rod when said second spring expands.

2. A mechanism according to claim 1, wherein said hinged levers co-operate with slopes carried by the cover of said first cylinder; said slopes communicating motion to said levers enabling said levers to move together to allow them to pass through said collar while said first spring is expanding and while said second spring is already in the expanded condition.

3. A mechanism according to claim 1, wherein the third cylinder is connected to a device which communicates translation motion thereto for re-compressing said second spring.

4. A mechanism according to claim 3, wherein said device includes a chain fixed to the end of said third cylinder and capable of being wound round a wheel which is driven by an electric motor.

5. A three-pole circuit-breaker comprising three mechanisms according to claim 1.

* * * * *